US008647079B2

(12) United States Patent
Aoki et al.

(10) Patent No.: US 8,647,079 B2
(45) **Date of Patent: *Feb. 11, 2014**

(54) FAN ASSEMBLY

(75) Inventors: Michimasa Aoki, Kawasaki (JP); Masumi Suzuki, Kawasaki (JP); Tadanobu Matsumura, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 10 days.

This patent is subject to a terminal disclaimer.

(21) Appl. No.: 13/448,014

(22) Filed: Apr. 16, 2012

(65) Prior Publication Data

US 2012/0201704 A1 Aug. 9, 2012

Related U.S. Application Data

(60) Division of application No. 12/068,011, filed on Jan. 31, 2008, now Pat. No. 8,157,540, which is a continuation of application No. PCT/JP2005/018176, filed on Sep. 30, 2005.

(51) Int. Cl.
*F04B 35/04* (2006.01)
*H02K 7/20* (2006.01)

(52) U.S. Cl.
USPC ..... 417/354; 417/423.14; 361/695; 361/697

(58) Field of Classification Search
USPC ..... 417/366, 423.14, 423.15, 354; 415/206; 361/695–697
See application file for complete search history.

(56) References Cited

U.S. PATENT DOCUMENTS

| | | | | |
|---|---|---|---|---|
| 2,776,088 | A | 1/1957 | Wentling | |
| 3,597,117 | A | 8/1971 | Zoehfeld | |
| 3,601,507 | A | 8/1971 | Harris | |
| 5,904,471 | A | 5/1999 | Woollenweber et al. | |
| 5,940,268 | A * | 8/1999 | Miyahara et al. | 361/697 |
| 6,781,835 | B2 | 8/2004 | Hashimoto et al. | |
| 6,873,069 | B1 | 3/2005 | Odagiri et al. | |
| 6,909,604 | B2 | 6/2005 | Tanaka et al. | |
| 6,916,160 | B2 | 7/2005 | Obara | |
| 6,917,521 | B2 * | 7/2005 | Tomioka et al. | 361/695 |

(Continued)

FOREIGN PATENT DOCUMENTS

| | | |
|---|---|---|
| JP | 35-12655 | 6/1960 |
| JP | 3-43310 U | 4/1991 |

(Continued)

OTHER PUBLICATIONS

JP Office Action, Application No. 2012-083223 mailed date Feb. 19, 2013.

(Continued)

*Primary Examiner* — Charles Freay
(74) *Attorney, Agent, or Firm* — Arent Fox LLP

(57) ABSTRACT

A centrifugal fan assembly has a fan with a number of vanes at a peripheral edge of a rotor, a motor, arranged coaxially to the inside of the rotor, that rotates the fan, and a casing that houses the fan and the motor. The casing has an air inlet in the direction of a rotating shaft of the fan, and an air outlet in a radial direction. A first part of the casing near the air inlet is arranged relatively towards a center of the casing as compared to the other part of the casing. The motor is mounted on the first part.

13 Claims, 7 Drawing Sheets

(56) References Cited

U.S. PATENT DOCUMENTS

| | | | | |
|---|---|---|---|---|
| 7,248,473 | B2 | 7/2007 | Ohnishi et al. | |
| 8,157,540 | B2 * | 4/2012 | Aoki et al. | 417/354 |
| 2002/0172008 | A1 | 11/2002 | Michael | |
| 2004/0085729 | A1 | 5/2004 | Lin | |
| 2005/0058543 | A1 | 3/2005 | Takeshita et al. | |
| 2005/0180867 | A1 | 8/2005 | Takahashi et al. | |

FOREIGN PATENT DOCUMENTS

| | | | |
|---|---|---|---|
| JP | 08-338396 | A | 12/1996 |
| JP | 3056876 | U | 12/1998 |
| JP | 3059676 | U | 3/1999 |
| JP | 2002-112499 | A | 4/2002 |
| JP | 2003-227491 | A | 8/2003 |
| JP | 2004-052735 | A | 2/2004 |
| JP | 2004-092446 | A | 3/2004 |
| JP | 2004-508498 | A | 3/2004 |
| JP | 2004-270463 | A | 9/2004 |
| JP | 2005-090346 | A | 4/2005 |
| JP | 2005-127319 | A | 5/2005 |
| JP | 3111084 | U | 5/2005 |
| WO | WO-02/20994 | A1 | 3/2002 |
| WO | WO-2007/043119 | A1 | 4/2007 |

OTHER PUBLICATIONS

JP Office Action, Application No. 2012-083224 mailed date Feb. 19, 2013.

English Translation of Interrogation, date mailed Jul. 10, 2012.

* cited by examiner

FAN ASSEMBLY

CROSS-REFERENCE TO RELATED APPLICATION

This is a Divisional Application, which claims the benefit of U.S. patent application Ser. No. 12/068,011, filed Jan. 31, 2008, now U.S. Pat. No. 8,157,540, which is a Continuation of International Application No. PCT/JP2005/018176, filed Sep. 30, 2005. The entire contents of which are incorporated herein by reference.

BACKGROUND OF THE INVENTION

1. Field of the Invention

The present invention relates to a fan assembly.

2. Description of the Related Art

Up until now, fan assemblies have been used in various equipment such as OA (Office Automation) equipment and electrical household appliances to cool parts or air that are heated due to the heat generated while driving the equipment. In particular, the amount of heat generated during the operation of CPU chips and other LSI's (Large Scale Integrations) has increased for personal computers and server equipment in accompaniment with dramatic increases in the processing speed. Fan assemblies that are more compact, have increased capacity, and have higher efficiency are therefore required.

A fan assembly such as shown, for example, in FIG. 12 to FIG. 15 is known in the art. FIG. 12 is a cross-sectional view along a line D-D shown in FIG. 13, which is a bottom view of the conventional fan assembly 100. FIG. 14 is a cross-sectional view depicting near a cable fixing member. FIG. 15 is a cross-sectional view depicting the cable fixing section along a line E-E shown in FIG. 14. An arrow denoted by F in FIG. 12 schematically depicts the flow of air.

As shown in FIGS. 12 to 14, the fan assembly 100, which is a centrifugal fan assembly, includes a fan 13 having a number of vanes 12 at a peripheral edge of a rotor 11, a motor 15, positioned coaxially to the inside of the rotor 11, that rotates the fan 13, and a casing 20, housing the fan 13 and the motor 15. The casing 20 has air inlets 16 and 17 in the direction of the axis of rotation of the fan 13 and having an air outlet 18 in a radial direction of the fan 13. Air taken in through the air, inlets 16 and 17 is then ventilated from the air outlet 18 by rotation of the fan 13.

The rotor 11 is cylindrical and has a top portion 11*a* and a side portion 11*b*. A hole 20*a* in the casing 20 is for screwing the casing 20 to a printed wiring board 42.

The rotor 11 of the motor 15 functions as the fan 13. Namely, the rotor 11 includes a rotating shaft (motor) 14 installed vertically from a center part of the inner wall of the top portion 11*a* and a magnet (motor) 22 provided at an inner peripheral surface of the side portion 11*b*. The rotating shaft 14 is made of metal.

A stator of the motor 15 includes a bearing (motor) 23 that supports the rotating shaft 14 in a freely rotating manner, a support member (motor) 24 that supports this bearing 23, fixed to a motor mounting member 130, a control substrate 27 mounted with a control IC 26 that controls drive current etc., and a coil 25 fixed to the control substrate 27.

The motor mounting member 130 is for mounting the motor 15. The motor mounting member 130 is arranged so that a part of the bottom surface of the casing 20 near the air inlet 17 projects further outwards (downwards) than another outer surface portion 21 of the casing 20. The motor mounting member 130 is connected to a peripheral edge of the opening of the air inlet 17 by three to four ribs 131.

As shown in FIG. 12 to FIG. 15, a cable 40 from the control substrate 27 is ran along the outer surface (bottom) of the casing 20, is led to outside of the casing 20, and is connected to a connector 41 on the printed wiring board 42.

Fan assemblies where portions corresponding to the motor mounting member 130 do not project outwards (downwards) from the other outer surface portion of the casing are also known. Such a fan assembly has been disclosed in Japanese Laid-open Patent Publication No. H. 2004-52735.

A large fan assembly is necessary to cool devices and LSI's generating a large amount of heat. In particular, in the conventional fan assembly shown in FIGS. 12 to 14, the motor mounting member 130 projects further outwards (downwards) than the other outer surface portion 21 of the casing 20. It is therefore not possible to ensure sufficient air duct space between the motor mounting member 130 and the printed wiring board 42. Moreover, such an arrangement reduces the degree of freedom with regards to assembly layout and mounting and means that the assembly is large.

SUMMARY OF THE INVENTION

It is an object of the present invention to at least partially solve the problems in the conventional technology.

According to an aspect of the present invention, there is provided a fan assembly including a fan including a rotor and a plurality of vanes attached to a periphery of the rotor; a motor, arranged coaxially within the rotor, that drives the rotor thereby rotating the fan; and a casing that houses the fan and the motor, having an air inlet in the direction of the rotating axis of the fan and having an air outlet in a radial direction of the fan, wherein air taken in the casing from an air inlet due to rotation of a fan is ventilated to the air outlet. The casing having a first portion that is around the air inlet; and a second portion that is further away from the air inlet than the first portion. The first portion is arranged relatively towards a center of the casing than the second portion, and the motor is mounted on the first portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following is a detailed description based on the drawings of exemplary embodiments of a fan assembly of the present invention. The present invention is by no means limited to these embodiments. In the following explanation, members that are the same as or correspond to members already described are given the same numbers and their description is either omitted or simplified.

Figure 1:
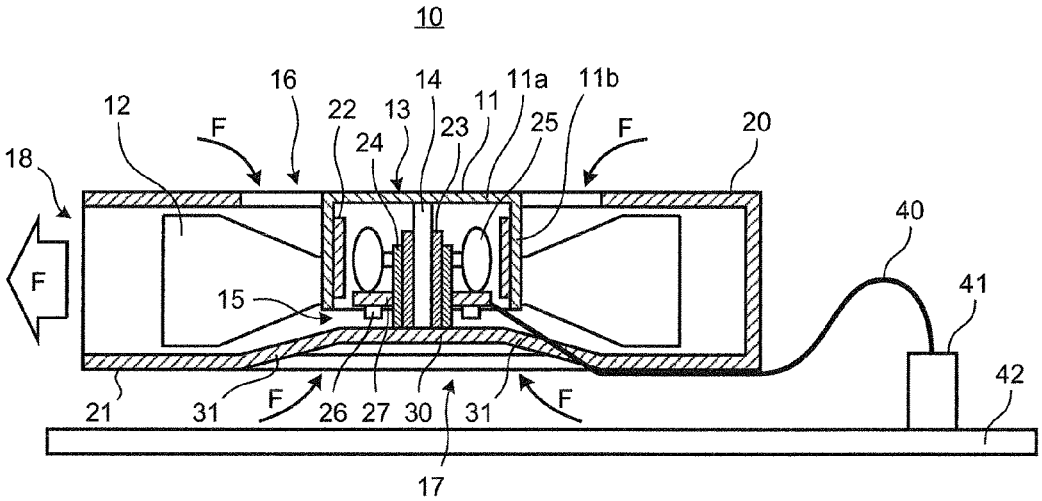
FIG. 1 is a cross-sectional view of a fan assembly according to a first embodiment of the present invention.
Figure 2:
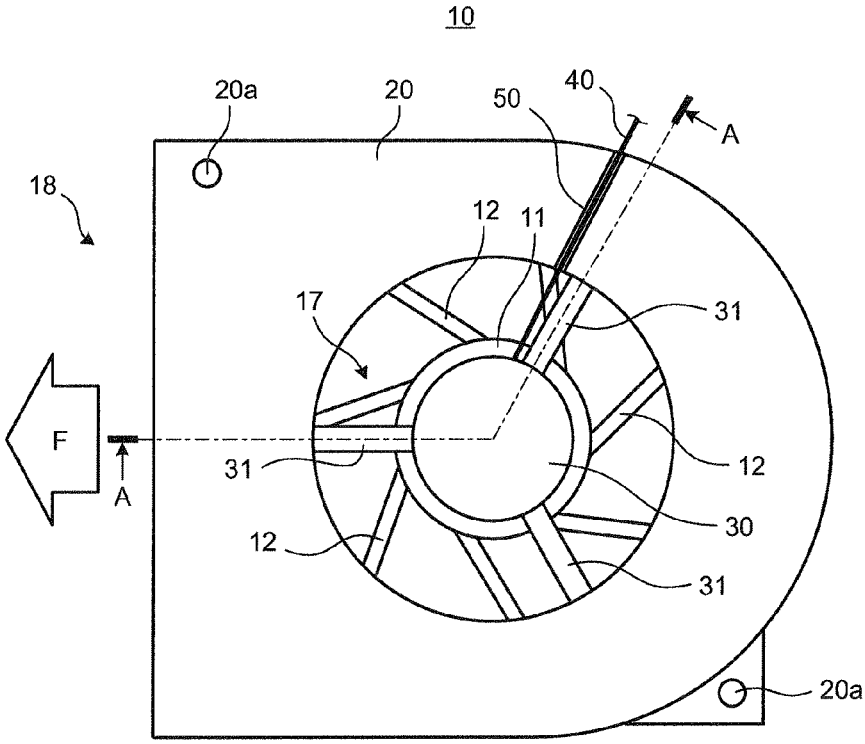
FIG. 2 is a bottom view of the fan assembly shown in FIG. 1.
Figure 3:
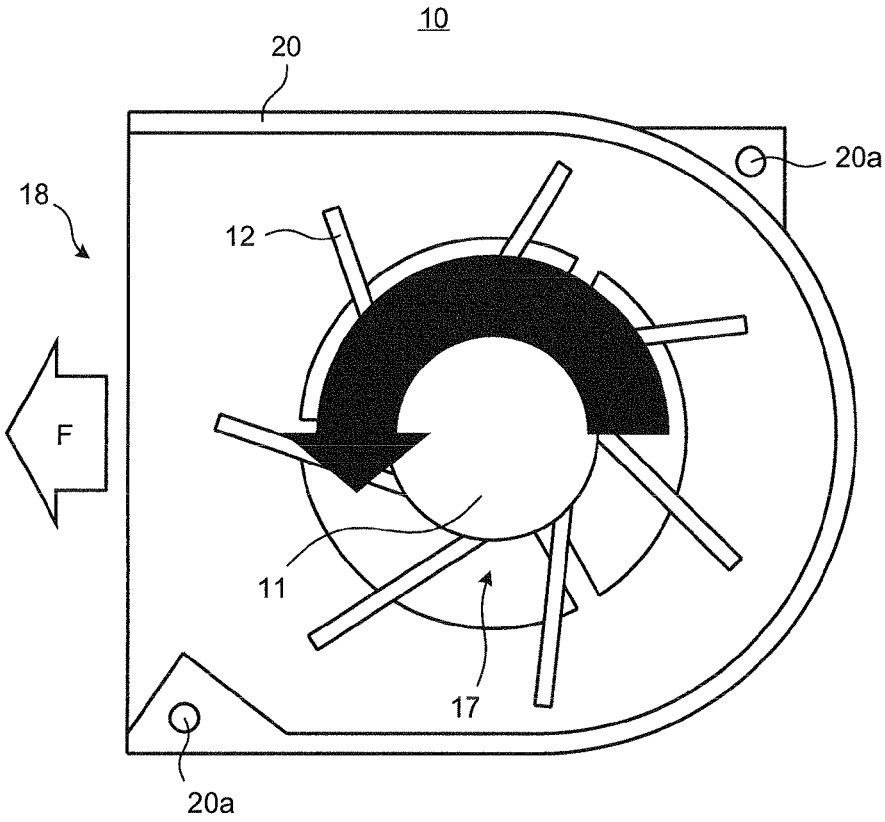
FIG. 3 is a plan view of the inside of the fan assembly shown in FIG. 1.
Figure 4:
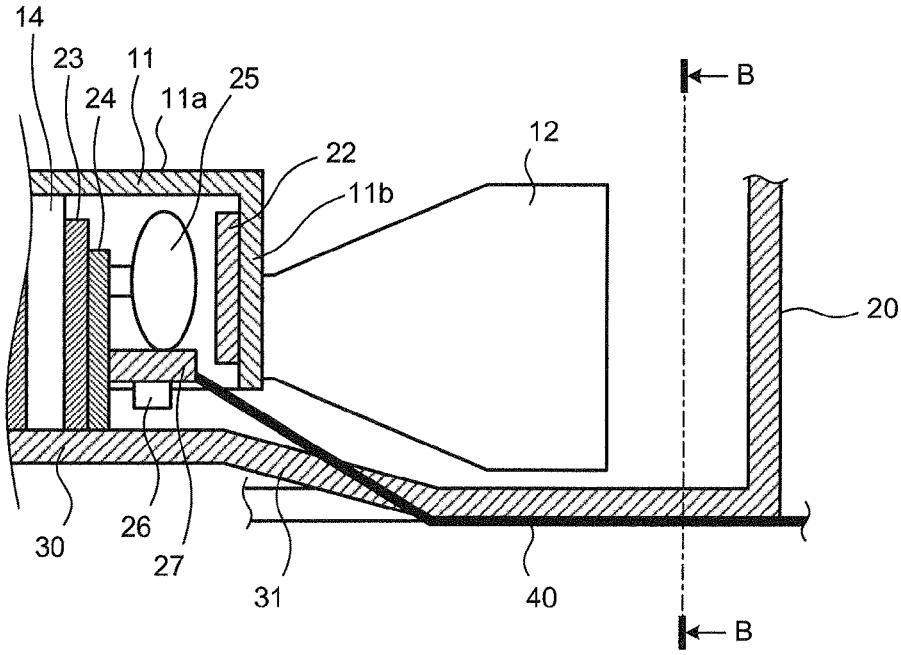
FIG. 4 is a cross-sectional view depicting near a cable fixing member shown in FIG. 1.
Figure 5:
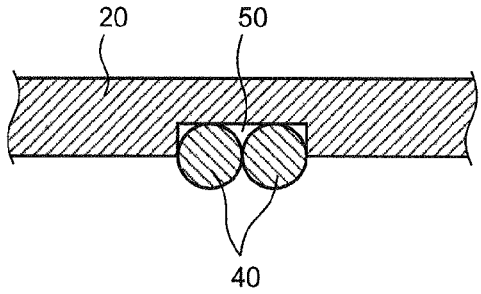
FIG. 5 is a cross-sectional view taken along a line B-B shown in FIG. 4.

FIG. 1 is a cross-sectional view along a line A-A shown in FIG. 2, which is a fan assembly 10 according to a first embodiment of the present invention. FIG. 2 is a bottom view of the fan assembly 10, FIG. 3 is a plan view of the inside of the fan assembly 10, FIG. 4 is a cross-sectional view near a cable fixing member shown in FIG. 1, and FIG. 5 is a cross-sectional view along a line B-B shown FIG. 4 depicting the cable fixing member.

An arrow denoted by F in FIG. 1 schematically depicts the flow of air. The circular broad arrow filled-in in black in FIG. 3 depicts the direction of rotation of a fan 13.

As shown in FIGS. 1 to 4, the fan assembly 10, which is a centrifugal fan assembly, includes the fan 13 having a number of vanes 12 at a peripheral edge of the rotor 11, the motor 15, positioned coaxially to the inside of the rotor 11, that rotates the fan 13, and the casing 20, housing the fan 13 and the motor 15. The casing 20 has the air inlets 16 and 17 in the direction of the axis of rotation of the fan 13 and having the air outlet 18 in a radial direction of the fan 13. Air taken in through the air inlets 16 and 17 is then ventilated from the air outlet 18 due to rotation of the fan 13.

The rotor 11 is cylindrical and has the top portion 11*a* and the side portion 11*b*. The vanes 12 provided at the rotor 11 and the side portion 11*b* are formed integrally using, for example, synthetic resin.

The casing 20 can be formed from, for example, aluminum or an aluminum alloy but can also be formed from synthetic resin.

The control substrate 27 is fixed to the support member 24 so that a mounting surface for the control IC 26 faces downwards. It is therefore easier for air taken in from the air inlet 17 to collide with the control IC 26.

Further, the support member 24 is formed of a material of high thermal conductivity such as, for example, aluminum or an aluminum alloy. As a result, the frictional heat of the bearing 23 generated as a result of rotation of the fan 13, the heat of the control IC 26 transmitted via the control substrate 27, and the heat generated by the coil 25 can be easily conducted to and dissipated by a motor mounting member 30 via the support member 24, and it becomes easier for cooling by air taken in from the air inlet 17 to take place.

The motor mounting member 30 is for mounting the motor 15. The motor mounting member 30 has a part of a bottom surface of the casing 20 near the air inlet 17 arranged inside of the other outer surface portion 21 of the casing 20. The motor mounting member 30 is connected to a peripheral edge of the opening of the air inlet 17 by three to four ribs 31. In the first embodiment the ribs 31 are arranged radially, but the arrangement is by no means limited to this.

By forming the motor mounting member 30 in this way, it is possible to ensure sufficient air vent space between the motor mounting member 30 and the printed wiring board 42. The cooling efficiency of the motor 15 increases; because, more wind is supplied to the motor 15.

This means that a wider margin can be achieved for the permissible temperature of the motor 15 so that it is possible to increase the rotational speed of the motor 15. It is therefore also possible to increase the wind-blowing capacity of the fan assembly 10.

In this manner, sufficient air vent apace can be created between the motor mounting member 30 and the printed wiring board 42 by forming the motor mounting member 30 as described above. It is therefore possible to enlarge an area for mounting parts (not shown) arranged on the printed wiring board 42 and the degree of freedom of the design layout can be increased.

The casing 20 is provided with a channel 50 that houses part of the cable (wiring) 40 taken to outside of the casing 20 from the control substrate 27, as shown in FIGS. 2 to 5. Namely, part of the cable 40 is inserted into and housed at the channel 50 and is fixed using adhesive tape or adhesive.

As a result, an operation of deciding positioning to a fitting position for the cable 40 is straightforward, and is also straightforward when the cable 40 housed in the channel 50 is fixed through adhesion. This improves ease with which the assembly can be put together.

It is also possible to suppress flexing of the cable 40 by fixing the cable 40 as described above. It is therefore possible to prevent the flexed cable 40 from coming into contact with the rotating fan 13, in other words, it is possible to get rid of the fear of an insulating coating of the cable 40 from becoming damaged or from becoming cut.

According to the fan assembly 10, the motor mounting member 30 is arranged to the inside of the other outer surface portion 21 of the casing 20. It is therefore possible to ensure sufficient air duct space between the motor mounting member 30 and the printed wiring board 42 so that it is possible to provide a compact, high-performance fan assembly 10.

Figure 6:
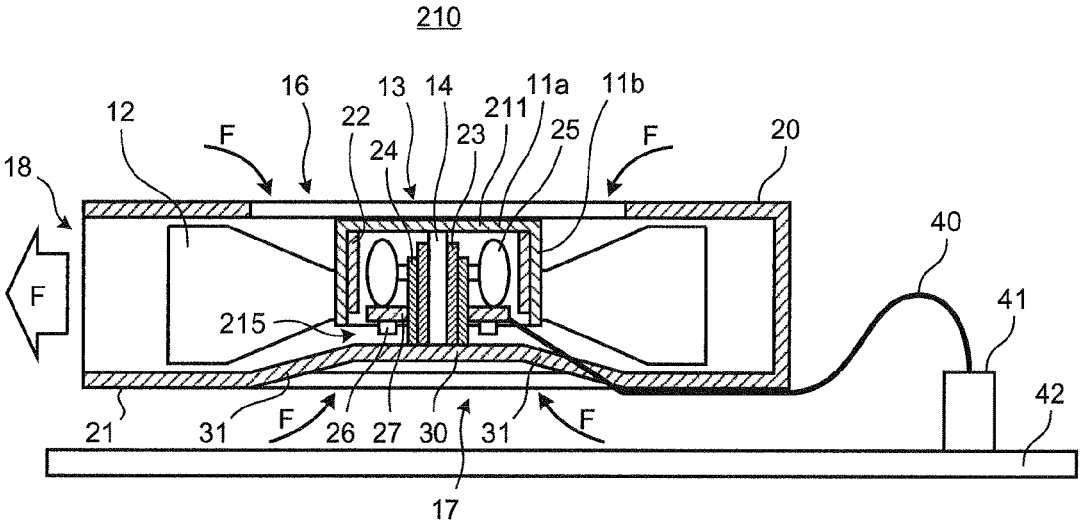
FIG. 6 is a cross-sectional view of a fan assembly according to a second embodiment of the present invention.

FIG. 6 is a cross-sectional view showing a fan assembly 210 according to a second embodiment of the present invention. In the fan assembly 210, a low-height motor 215 and a low-height rotor 211 are employed. The rest of the parts are the same as those in the fan assembly 210.

In the second embodiment, it is possible to ensure sufficient air vent space between the motor mounting member 30 and the printed wiring board 42. The cooling efficiency of the motor 215 increases; because, more wind is supplied to the motor 15. As a result, a wider margin can be achieved for the permissible temperature of the motor 215 so that it is possible to increase the rotational speed of the motor 215. It is therefore also possible to increase the wind-blowing capacity of the fan assembly 210.

When an amount of wind that is the same as in the related art is to be obtained, it is possible to make the height of the motor 215 and the height of the rotor 211 lower than in the related art. The second embodiment therefore implements this and increases the air inlet space of the air inlet 16 at the upper part of the fan 13.

The amount of wind from the air inlet 16 is also increased from the case of the first embodiment, and the cooling efficiency of the motor 215 is increased still further. Other aspects of the structure are the same as for the case of the first embodiment and are not explained again.

According to the fan assembly 210, in addition to achieving the same results as for the first embodiment, the amount of wind from the air inlet 16 is further increased and cooling efficiency of the motor 15 is also increased further.

Figure 7:
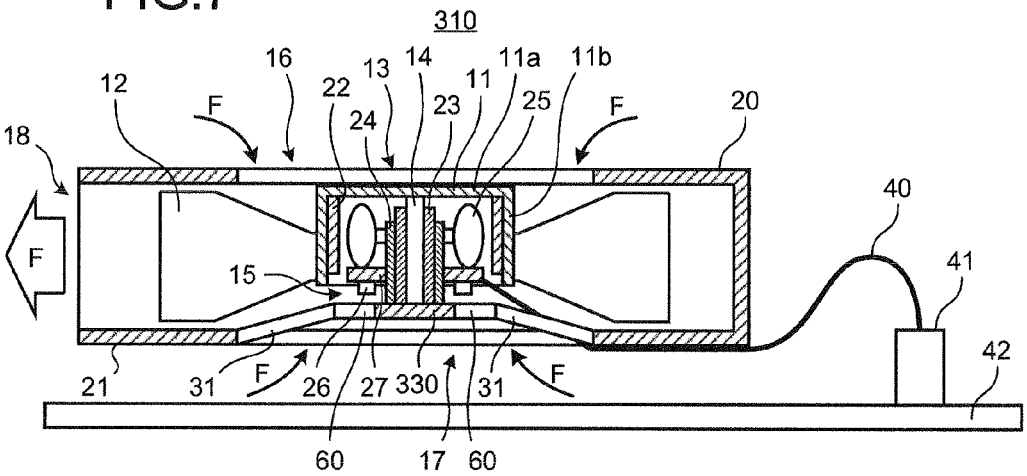
FIG. 7 is a cross-sectional view of a fan assembly according to a third embodiment of the present invention.
Figure 8:
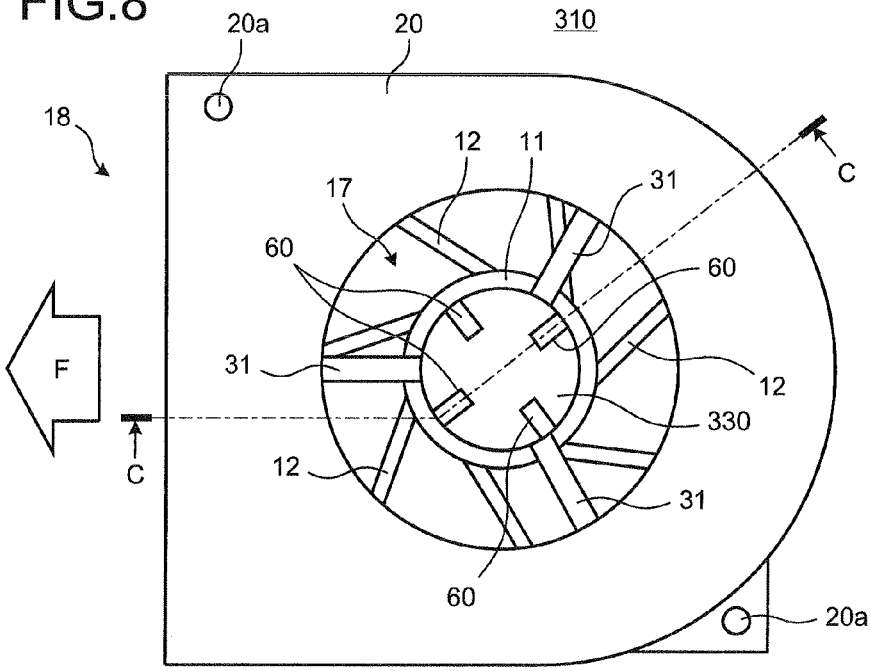
FIG. 8 is a bottom view of the fan assembly shown in FIG. 7.

FIG. 7 is a cross-sectional view of a fan assembly 310 according to a third embodiment of the present invention taken along a line C-C shown in FIG. 8, which is a bottom view of the fan assembly 310.

As shown in FIGS. 7 and 8, in the fan assembly 310 includes a plurality (for example, four) of rectangular slits (notched sections) 60 provided at a motor mounting member 330 so that air taken in passes through easily.

The control IC 26 of the control substrate 27 is arranged close to the slits 60 so that air taken in passing through the slits 60 collides easily with the control IC 26. The rest of the structure of the fan assembly 310 is the same as that of the fan assembly 210 and will not be explained again.

In the fan assembly 310, in addition to achieving the same results as the case of the second embodiment, it is easy for air taken in passing through the slits 60 to collide with the control IC 26 of the control substrate 27 and it is possible to promote the dissipation of heat of the control IC 26. It is also possible to promote the dissipation of heat for the bearing 23 and the coil 25 using air taken in through the slits 60.

Figure 9:
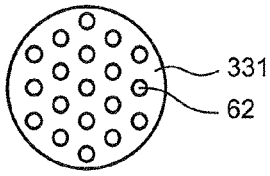
FIG. 9 is a bottom view of a motor mounting member shown in FIG. 7.

The number of the rectangular slits 60 is by no means limited to four. For example, as shown in FIG. 9, a large number of round holes (through-holes) 62 can also be provided in a motor mounting member 331. The same results as for the third embodiment can also be anticipated in this case. FIG. 9 is a bottom view depicting a motor mounting member 331 provided with a large number of round holes.

Figure 10:
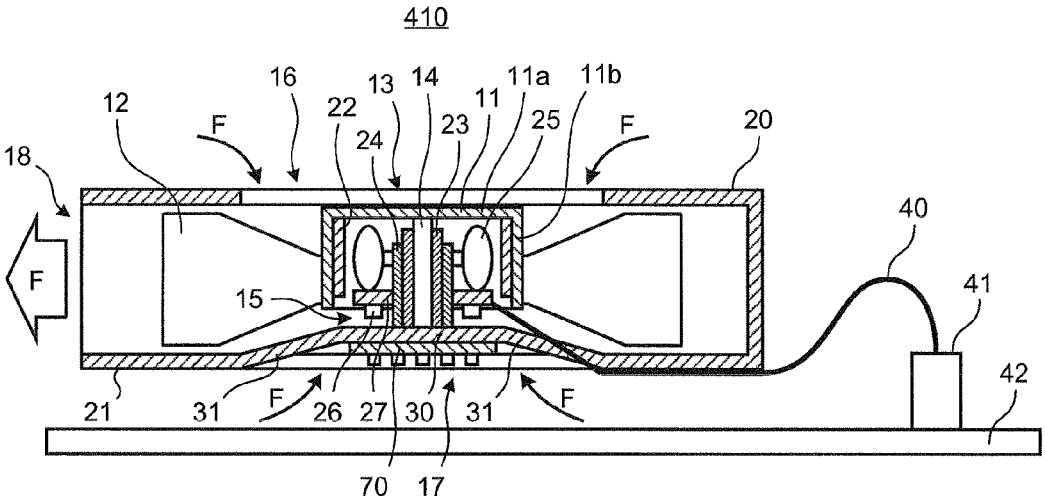
FIG. 10 is a cross-sectional view of a fan assembly according to a fourth embodiment of the present invention.
Figure 11:
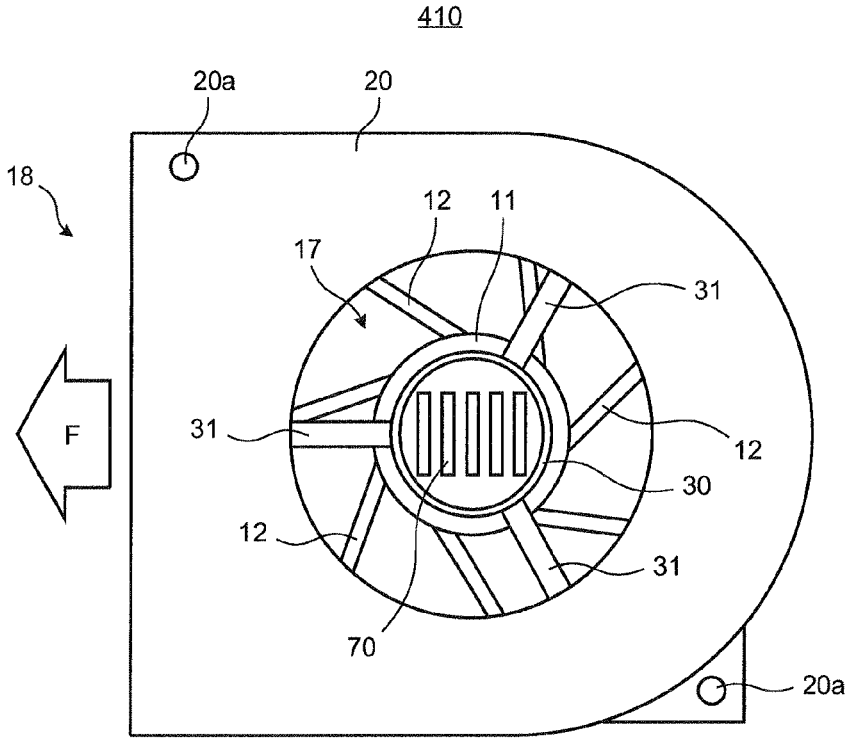
FIG. 11 is a bottom view of the fan assembly shown in FIG. 10.
Figure 12:
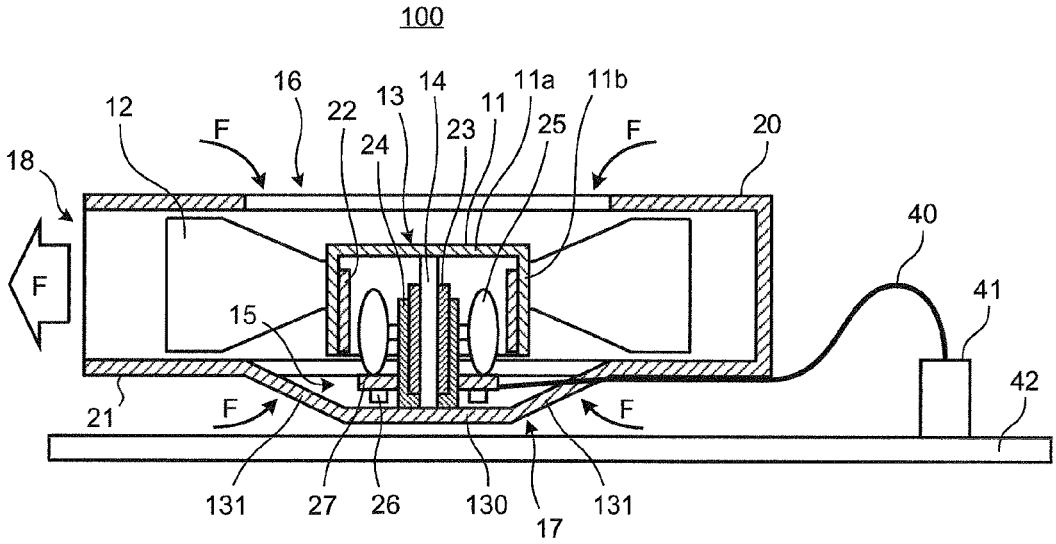
FIG. 12 is a cross-sectional view of a conventional fan assembly.
Figure 13:
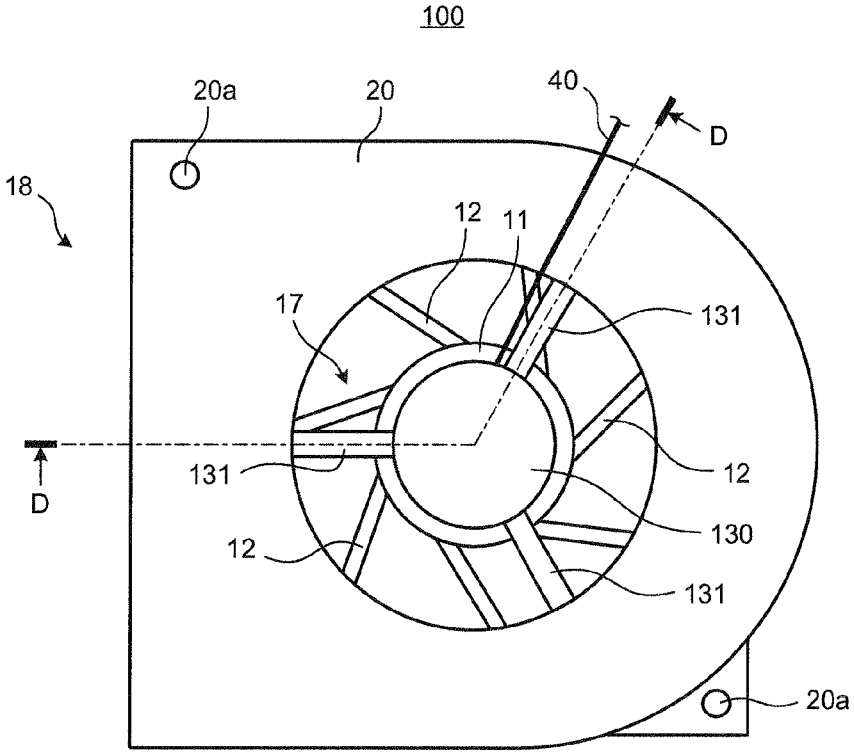
FIG. 13 is a bottom view of the fan assembly shown in FIG. 12.
Figure 14:
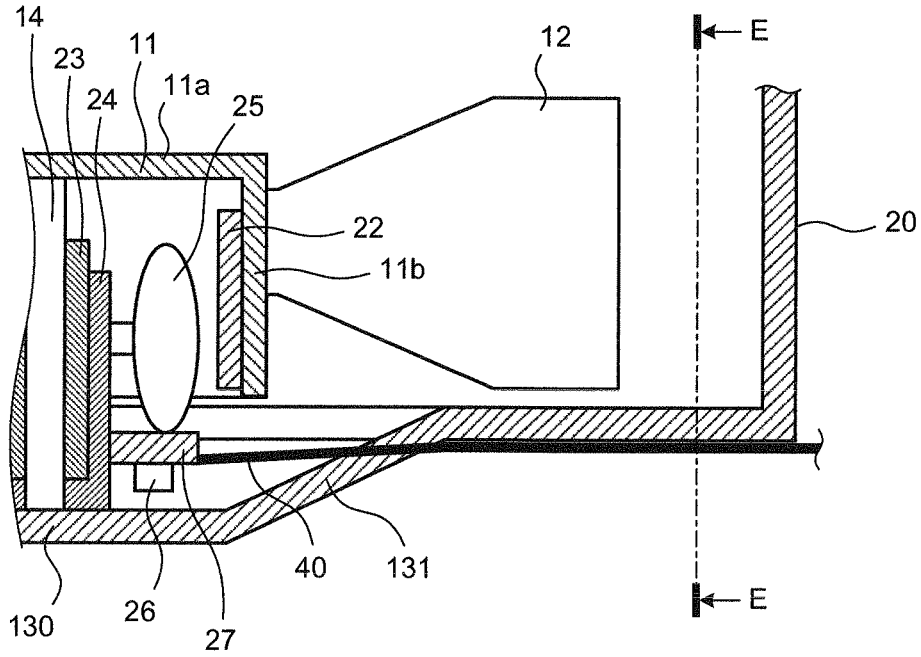
FIG. 14 is a cross-sectional view near a cable fixing member shown in FIG. 12.
Figure 15:
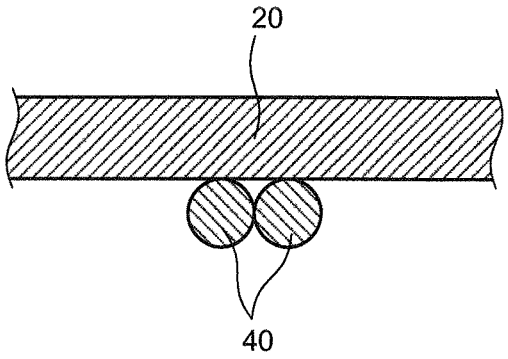
FIG. 15 is a cross-sectional view along a line E-E shown in FIG. 14.

FIG. 10 is a cross-sectional view of a fan assembly 410 according to a fourth embodiment of the present invention, and FIG. 11 is a bottom view of the fan assembly 410. As shown in FIGS. 10 and 11, the fan assembly 410 includes a heatsink (heat-dissipating member) 70 at the bottom surface of the motor mounting member 30.

The control substrate 27 mounted with the control IC 26 is arranged near the motor mounting member 30 via the support member 24 of superior thermal conductivity. The rest of the structure of the fan assembly 410 is the same as that of the fan assembly 210 and are not explained again.

In the fan assembly 410, in addition to achieving the same effects as the second embodiment, air taken in from the air inlet 17 collides with the heatsink 70 and the support member 24 dissipates heat together with the motor mounting member 30. It is therefore possible to dissipate heat of the control IC 26 of the control substrate 27 via the support member 24.

It is also possible to promote heat dissipation for the bearing 23 that is a structural member of the motor 15 and the coil 25 via the support member 24.

It is further possible to construct a heat-dissipating structure for the motor 15 at low cost by using the heatsink 70 that is a general purpose heat-dissipating member.

The heat-dissipating member is not limited to the heatsink 70. For example, a general purpose heat-dissipating member such as a lid or a heat spreader can also be used. The same results as for the fourth embodiment can also be anticipated in this case.

An explanation is given in the first to fourth embodiments where the air inlet 16 is provided at the casing 20 but, this is by no means limiting. In other words, providing that a predetermined amount of intake air can be ensured, it is also possible to provide only the air inlet 17, for example.

Moreover, an explanation is given for the first to fourth embodiments where the support member 24 the control substrate 27 is fixed to is secured to the motor supporting unit 30 (or 330, 331) but this is by no means limiting. In other words, the control substrate 27 may also be fixed directly to the motor mounting member 30 (or 330, 331) without the support member 24 being interposed in between.

An explanation is given in the first to fourth embodiments where three ribs 31 are provided but this is by no means limiting. In other words, the number of ribs 31 can be increased or decreased providing that a predetermined rigidity and strength is ensured and the influence of air intake resistance is considered.

According to an aspect of the present invention, a motor mounting member is arranged to the inside of the other outer surface portion of the casing. It is therefore possible to ensure sufficient air duct space between the motor mounting member and the printed wiring board so that it is possible to provide a compact, high-performance fan assembly.

Although the invention has been described with respect to specific embodiments for a complete and clear disclosure, the appended claims are not to be thus limited but are to be construed as embodying all modifications and alternative constructions that may occur to one skilled in the art, that fairly fall within the basic teaching herein set forth.

What is claimed is:

1. A fan assembly comprising:

a fan including a rotor and a plurality of vanes attached to a periphery of the rotor;

a motor, arranged coaxially within the rotor, that drives the rotor thereby rotating the fan; and a casing that houses the fan and the motor, having an air inlet in a direction of a rotating axis of the fan and having an air outlet in a radial direction of the fan, wherein air taken in the casing from the air inlet due to rotation of the fan is ventilated to the air outlet, the casing having;

a first portion that is located in an inner area of the air inlet and that includes a first surface and a second surface both of which are perpendicular to the direction of the rotating axis of the fan, the first surface facing an outer space of the case and the second surface facing to an inner space of the casing; and a second portion that is located in an outer area of the air inlet and that includes a third surface parallel to the first surface, the third surface facing the outer space of the case, the first surface being arranged closer to a center of the longitudinal direction of the rotating axis than the third surface, the motor being mounted on the second surface of the first portion.

2. The fan assembly according to claim 1, wherein the motor comprises electronic components for controlling rotation of the fan and a control board the electronic components are mounted on, the first portion is provided with a plurality of openings that allow air outside the casing to outside pass into the casing, and the control board is arranged such that the electronic components are arranged near the plurality of openings.

3. The fan assembly according to claim 1, wherein the motor comprises electronic components for controlling rotation of the fan and a control board the electronic components are mounted on, and the fan assembly further includes a heat-dissipating member that is arranged on the first portion.

4. The fan assembly according to claim 2, further comprising a support member via which the motor is fixed to the first portion, wherein the support member is made of a material of a high thermal conductivity.

5. The fan assembly according to claim 3, further comprising a support member via which the motor is fixed to the first portion, wherein the support member is made of a material of a high thermal conductivity.

6. The fan assembly according to claim 4, wherein the casing has a channel that houses part of wiring taken to outside of the casing from the control board.

7. The fan assembly according to claim 5, wherein the casing has a channel that houses part of wiring taken to outside of the casing from the control board.

8. The fan assembly of claim 3, wherein the heat-dissipating member is one or more selected from a group consisting of a heatsink, a lid, or a heat spreader.

9. The fan assembly of claim 1, wherein the first portion has a part of a bottom surface of the casing near the air inlet arranged inside of the second portion.

10. The fan assembly of claim 9, wherein the bottom surface of the casing is connected to a peripheral edge of the air inlet.

11. The fan assembly of claim 10, wherein the bottom surface of the casing is connected to the peripheral edge of the air inlet by ribs.

12. The fan assembly of claim 11, wherein the ribs are arranged radially.

13. The fan assembly of claim 1, wherein the first portion is adjacent to the air inlet.

* * * * *